US005669118A

United States Patent [19]

Frano et al.

[11] Patent Number: 5,669,118

[45] Date of Patent: Sep. 23, 1997

[54] STRAP RETAINER

[75] Inventors: Francis G. Frano, Hoffman Estates, Ill.; Paul F. Giampavolo, Old Tappan; Diane M. Sipp, Westwood, both of N.J.

[73] Assignee: Illinois Tool Works Inc., Ill.

[21] Appl. No.: 628,122

[22] Filed: Apr. 4, 1996

Related U.S. Application Data

[63] Continuation of Ser. No. 503,547, Jul. 18, 1995.

[51] Int. Cl.[6] ..... A44B 11/00

[52] U.S. Cl. ..... 24/265 AL; 24/198; 24/666; 24/707

[58] Field of Search ..... 24/265 AL, 198, 24/701, 666, 169, 170, 191, 599.1, 601.5, 265 CD; 403/291, 353

[56] References Cited

U.S. PATENT DOCUMENTS

| | | | |
|---|---|---|---|
| D. 358,701 | 5/1995 | Gordy et al. . | |
| 393,432 | 7/1968 | Jones et al. . | |
| 2,574,296 | 11/1951 | Smith | 24/265 AL |
| 3,288,192 | 11/1966 | Bollinger . | |
| 3,861,814 | 1/1975 | Fisher . | |
| 4,271,999 | 6/1981 | Stravitz | 24/666 |
| 4,550,800 | 11/1985 | Dietrich . | |
| 4,630,982 | 12/1986 | Fenner | 24/701 |
| 4,715,095 | 12/1987 | Takahashi . | |
| 4,793,726 | 12/1988 | Sword . | |
| 4,810,147 | 3/1989 | Hirohata . | |
| 4,860,409 | 8/1989 | Bering et al. . | |
| 4,932,105 | 6/1990 | Muller | 24/666 |
| 4,987,656 | 1/1991 | Sato . | |
| 4,993,127 | 2/1991 | Mechem et al. | 24/701 |
| 5,114,203 | 5/1992 | Carnes . | |
| 5,177,837 | 1/1993 | Rekuc | 24/198 |
| 5,201,099 | 4/1993 | Campbell | 24/198 |
| 5,215,332 | 6/1993 | DeSloovere . | |
| 5,353,571 | 10/1994 | Berdan et al. . | |

*Primary Examiner*—Victor N. Sakran
*Attorney, Agent, or Firm*—Kenyon & Kenyon

[57] ABSTRACT

The apparatus is a strap retainer with a straight post element and a generally arcuate retainer element molded as a single integral piece thereby forming a D-shaped outline. First ends of said post and arcuate retainer elements are affixed to each other while second ends of the post and arcuate retainer elements include complementary elements of a detent locking element. A first detent locking element includes a stem with a D-shaped cross section supporting a bulbous portion of increased cross section. The second detent locking element includes an aperture assembly with a first generally round aperture sized to receive the bulbous portion and a second aperture of D-shaped cross section sized to receive the stem of similar cross section and dimensions. The first and second apertures communicate by tapered walls which form detent edges on the second aperture. The stem can be slid from the first aperture to the second aperture to be detently locked in place therein.

30 Claims, 3 Drawing Sheets

STRAP RETAINER

This application is a continuation of U.S. application Ser. No. 08/503,547, filed Jul. 18, 1995.

BACKGROUND OF THE INVENTION

1. Field of the Invention

The apparatus of the present invention pertains to a strap retainer in the form of a locking D-ring, such as is used to secure a child's nylon seatbelt to a grocery cart or similar vehicle.

2. Background of the Invention

In the prior art, it is well-known to secure a nylon seatbelt-type child restraint apparatus to a grocery cart or similar vehicle in order to assure the safety of children riding in the shopping cart. It is imperative that such devices are securely attached to the shopping cart without the reasonable possibility of becoming accidentally disattached.

However, the prior art devices which have been used to secure the seatbelt-type child restraint apparatus to a grocery cart have typically included two parts—a metal ring and a plastic sleeve. The presence of two separate parts, one being made of metal, required increased manufacturing costs. Moreover, to install this device, a tool has been required. The use of a tool in addition to separate parts has increased the amount of time required to install the prior art device.

OBJECTS AND SUMMARY OF THE INVENTION

It is therefore an object of the present invention to provide a strap retainer which can secure a seatbelt-type child restraint apparatus to a grocery cart or similar apparatus without the reasonable possibility of becoming accidentally disattached.

It is therefore a further object of the present invention to provide a strap retainer which can be easily installed to secure a seatbelt-type child restraint apparatus to a grocery cart or similar apparatus.

It is therefore a still further object of the present invention to provide a strap retainer which can secure a seatbelt-type child restraint to a grocery cart or apparatus without the use of tools.

It is therefore a still further object of the present invention to provide a strap retainer in a single piece configuration which can secure a seatbelt-type child restraint apparatus to a grocery cart or similar apparatus.

It is therefore a still further object of the present invention to provide a strap retainer with low manufacturing costs.

These and other objects are achieved by providing a strap retainer in the form of a single piece plastic D-ring. The D-ring includes a post element and an arcuate retaining element. A first end of the post element is integral with a first end of the arcuate retaining element while the second end of the arcuate retaining element includes a keyhole-shaped detent arrangement and spring latch configuration for securing the second end of the post element in a fastened position. The second end of the post element includes a stem with a D-shaped cross section supporting a bulbous portion. The D-shaped cross section stem is particularly adapted to be secured by the keyhole-shaped detent arrangement of the arcuate retaining element while the bulbous portion is particularly adapted to be engaged by the spring latch element. In an unfastened position, when the second end of the post element is free from the second end of the arcuate retaining element, the loop portion of a seatbelt can be easily slipped over the post element and the arcuate retaining element can be easily slipped around a tubular portion of the grocery cart or similar vehicle. The D-shaped cross section stem of the post element is then inserted into the keyhole-shaped detent arrangement of the arcuate retaining element and snapped into the locked position. The spring latch element engages against the bulbous portion further securing the locked position.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
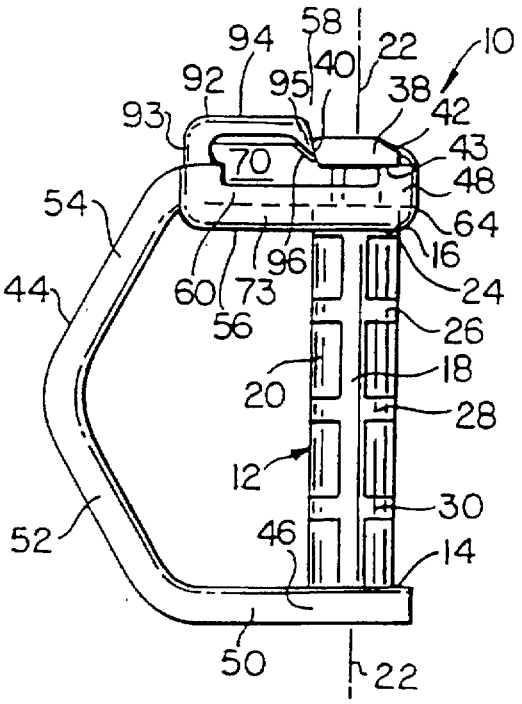
FIG. 1 is a front plan view, partially in phantom, of the apparatus of the present invention in a locked position.

Referring now to the drawings in detail wherein like numerals refer to like elements throughout the several views, one sees that FIG. 1 is a front plan view of the strap retainer apparatus 10 of the present invention in a locked position.

Strap retainer apparatus 10 is generally configured in a D-ring shape. Post element 12 is generally cylindrical with a first end 14 and a second end 16 but has an interior portion between ends 14 and 16 formed of web with flat vertical rib 18 at a right angle with similar flat vertical rib 20 (the terms "vertical" and "horizontal" are used with respect to the FIGS. 1–4 as illustrated). Both flat vertical ribs 18, 20 share a common longitudinal axis 22 with post element 12. Generally disk-shaped horizontal reinforcing rib 24 is generally oriented toward second end 16 and similar disk-shaped horizontal reinforcing ribs 26, 28, 30 are evenly spaced between reinforcing rib 24 and first end 14. The longitudinal axis 22 of post element 12 passes through the centers of disk-shaped horizontal reinforcing ribs 24, 26, 28, 30 thereby giving the generally cylindrical shape to post element 12. Of course, as strap retainer 10 is a single integrally molded piece, ribs 18, 20, 24, 26, 28 are integral with each other.

Figure 3:
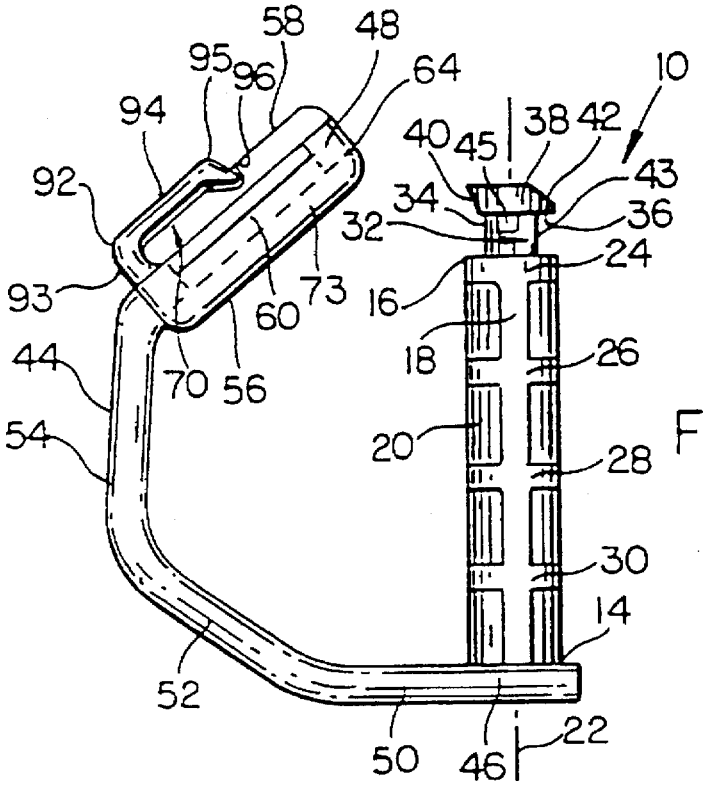
FIG. 3 is a front plan view, partially in phantom, of the apparatus of the present invention in an unlocked position.
Figure 5A:
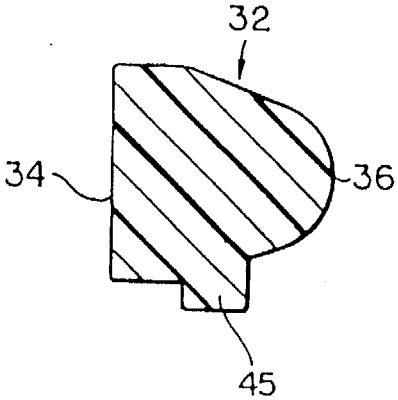
FIG. 5*a* is a cross-sectional view of the D-shaped cross section of the post element, particularly adapted to be engaged by the keyhole-shaped detent element of the arcuate element shown in FIG. 5*b*.
Figure 6A:
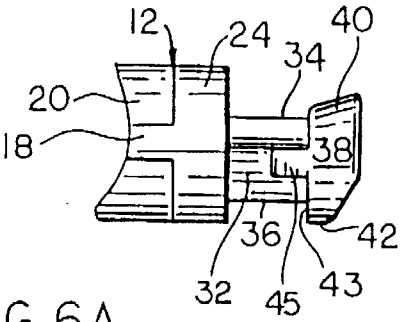
FIG. 6*a* is a plan view of the stem and bulbous portion of the post element of the apparatus of the present invention.
Figure 6C:
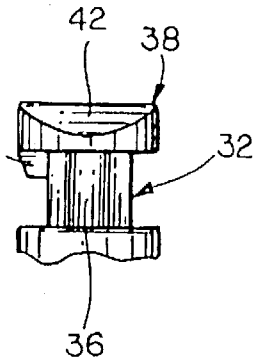
FIG. 6*c* is a front view of the bulbous portion of the post element of the apparatus of the present invention.

Referring to FIG. 3, which shows strap retainer 10 in an unlocked position, one sees that stem 32 is formed immediately above horizontal reinforcing rib 24. As shown in FIG. 5*a* (and to a lesser extent, FIG. 4), stem 32 has a D-shaped cross section with an inwardly-facing flat surface 34 and an outwardly-facing arcuate surface 36. As will be explained in greater detail later, the inwardly-facing flat surface 34 and the outwardly-facing arcuate surface 36 play important roles in the locking mechanism of the strap retainer 10 with simple engagement and subsequent difficult disengagement. As shown in FIGS. 3, 4, 6*a* and 6*b*, bulbous portion 38 is formed above stem 32 with a diameter greater than that of stem 32. Bulbous portion 38 further includes an inwardly-facing backwardly-inclined flat face 40 and an outwardly-facing forwardly-inclined face 42. Lower surface 43 is defined by the bottom of bulbous portion 38. As further shown in FIGS. 5*a*, 6*a*, 6*b* and 6*c*, ramped section 45 is formed on one side of arcuate surface 36 of stem 32, from immediately below lower surface 43 extending downwardly about half of the length of stem 32. As shown in FIG. 6*c*, ramped section 45 inclines inwardly somewhat as it extends downwardly away from lower surface 43. As will be explained in more detail hereinafter, the purpose of ramped section 45 is to guide bulbous portion 38 during the locking procedure so as to prevent interference.

Referring back to FIG. 1, one sees that arcuate retaining element 44 includes a first end 46 and a second end 48. First end 46 of arcuate retaining element 44 is integral with first end 14 of post element 12 while, as will be described in greater detail hereinafter, second end 48 of arcuate retaining element 44 is lockably engageable with second end 16 of post element 12.

Arcuate retaining element 44 has a general arcuate outline giving a D-shaped profile to strap retainer 10. On closer inspection, one sees that arcuate retaining element 44 is formed from four generally straight sections—lower horizontal section 50 which includes first end 46 and extends at a right angle from first end 14 of post element 12; lower inclined element 52 rising from lower horizontal section 50; upper inclined element 54 rising from lower inclined element 52; and upper horizontal element 56 extending from upper inclined element 54 and including second end 48 and locking mechanism 58 to lockably engage second end 16 of post element 12. Again, the terms "horizontal", "vertical", "upper", "lower" and "inclined" are used with respect to the orientation of strap retainer 10 as shown in FIGS. 1–4.

Arcuate retaining element 44 is a single molded piece (integral with post element 12) with sufficient flexibility so that, in an unlocked state, arcuate retaining element 44 can easily flexed to the position shown in FIG. 3 so that a looped portion of a seatbelt 100 of a child restraint apparatus or similar apparatus and the tubular portion 200 of a frame of a shopping cart or similar vehicle can be inserted within strap retainer 10. By subsequently lockably engaging locking mechanism 58 to second end 16 of post element 12, the locked configuration of FIG. 2, whereby tubular portion 200 is retained to looped portion of seatbelt 100, is achieved.

Figure 4:
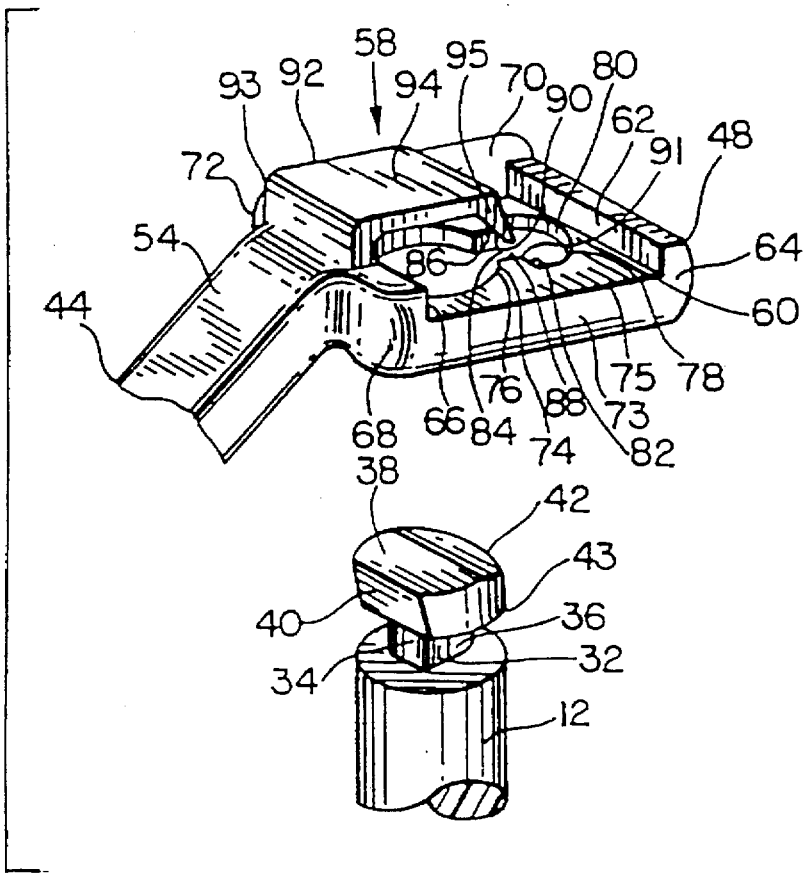
FIG. 4 is a perspective view of the post element, detent element, and spring latch element of the present invention in the unlocked position.

Referring now to FIG. 4, one sees that locking mechanism 58 on second end 48 of arcuate engaging element 44 includes a generally planar horizontal base section 60 with first upwardly formed lip 62 on a distal end 64 thereof, second upwardly formed lip 66 on a proximal end 68 thereof, and third upwardly formed lip 70 on a rear portion 72 thereof. Additionally, downwardly extending lip 73 extends from a front portion 75 of generally planar horizontal base section 60.

Figure 5B:
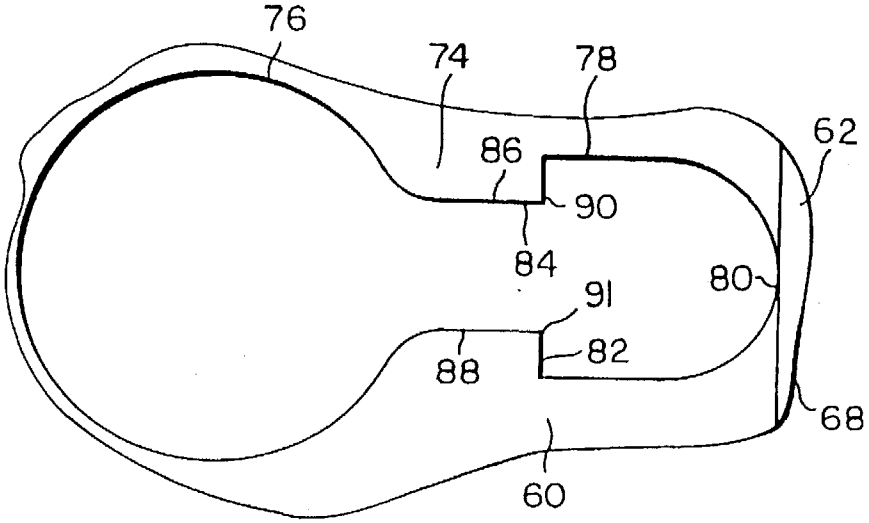
FIG. 5*b* a cross-sectional top view of the keyhole-shaped detent element or aperture assembly of the arcuate element of the apparatus of the present invention.
Figure 6B:
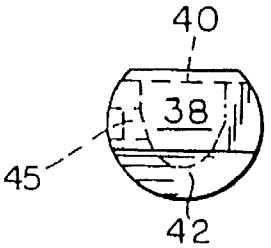
FIG. 6*b* is a top view of the bulbous portion of the post element of the apparatus of the present invention.

FIG. 5*b* illustrates the aperture element 74 formed on base section 60 of locking mechanism 58. Aperture element 74 includes two portions, a generally round first aperture 76 of a larger diameter and a generally D-shaped second aperture 78 of a smaller diameter. D-shaped second aperture 78 includes an arcuate portion 80 facing outward to distal end 64 of locking mechanism 58. D-shaped second aperture 78 further includes straight portion 82 facing first aperture 76.

Generally round first aperture 76 is sized to allow bulbous portion 38 to pass therethrough during the locking procedure. Likewise, D-shaped second aperture 78 is sized to accommodate the D-shaped cross section of stem 32 (see FIG. 5*a*) without being large enough to allow bulbous portion 38 to pass therethrough after the locking procedure has been completed.

Passageway 84 is formed from tapering walls 86, 88 which communicate from a larger section in generally round first aperture 76 to a smaller section on straight portion 82 of D-shaped second aperture 78. The intersection of tapering walls 86, 88 and straight portion 82 of D-shaped second aperture 78 forms detent edges 90, 91, respectively, on straight portion 82. Aperture element 74 therefore has a "key-hole" type configuration and appearance.

Figure 2:
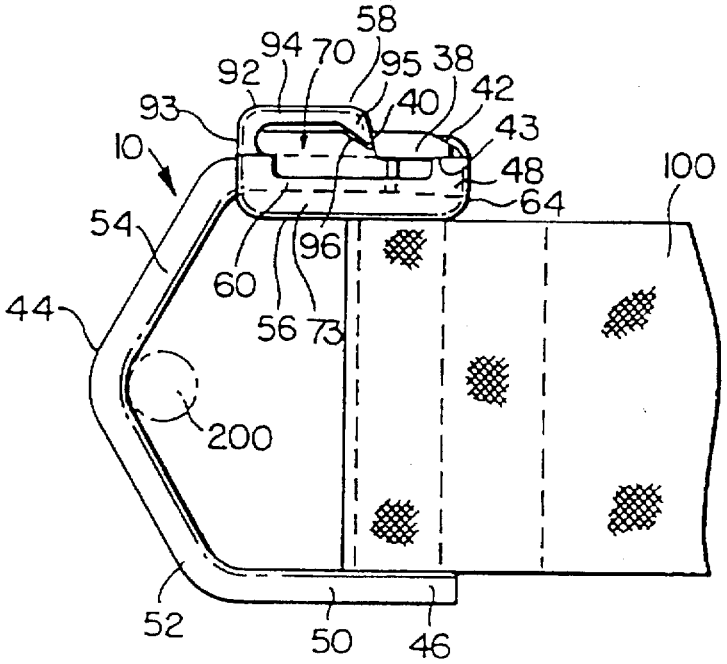
FIG. 2 is a front plan view, partially in phantom, of the apparatus of the present invention in a locked position, shown engaging a looped portion of the seatbelt and a portion of the tubular frame of the grocery cart or similar vehicle.

As further shown in FIGS. 1, 2 and 4, locking mechanism 58 further includes spring latch 92 which includes a vertical portion 93 arching upwardly from second upwardly formed lip 66 on proximal end 68 of planar horizontal base section 60. Spring latch 92 further includes horizontal portion 94 cantilevered forward from vertical portion 93 over first aperture 76 and terminating in a downwardly-inclined distal tip 95. As shown in FIGS. 1 and 2, downwardly-inclined distal tip 95 is configured to align adjacently with (or possibly abut) inwardly-facing backwardly-inclined flat face 40 of bulbous portion 38 in the locked position so as to limit the travel of bulbous portion 38 and hence post element 12.

As further shown in FIGS. 1, 2 and 3, third upwardly formed lip 70 includes a downwardly-pointing notch 96 to accommodate the travel of downwardly-inclined distal tip 95.

To operate strap retainer 10, the user starts with strap retainer 10 in the unlocked position as shown in FIG. 3. The user then slips a looped portion of a seatbelt 100 of a child restraint apparatus or similar apparatus over post element 12 and flexes arcuate retaining element 44 so as to retain or engage the tubular portion 200 of a frame of a shopping cart or similar vehicle. The user then inserts bulbous portion 38 into generally round first aperture 76 of aperture assembly 74. Ramped section 45 guides bulbous portion 38 through generally round first aperture 76 of aperture assembly 74 so as not to cause interference with tapering walls 86, 88 during the locking procedure. Arcuate surface 36 of stem 32 self-aligns with tapering walls 86, 88 and ramped section 45 urges stem 32 fully into generally round first aperture 76. The user urges the post element 12 forward so as to flex tapering walls 86, 88 apart and allow stem 32 to enter D-shaped second aperture 78 of aperture assembly 74. When stem 32 enters D-shaped second aperture 78, tapering walls 86, 88 snap back into their original orientation. Arcuate surface 36 of stem 32 aligns with arcuate portion 80 of D-shaped second aperture 78 and flat surface 34 of stem 32 aligns with straight portion 82 of D-shaped second aperture 78. Detent edges 90, 91 further engage flat surface 34 of stem 32. As shown in FIGS. 1 and 2, the lower surface 43 of bulbous portion 38 further aligns with first upwardly formed lip 62 of horizontal planar base section 60. As the interface of flat surface 34 and straight portion 82 is perpendicular to any contemplated movement of stem 32 back into generally round first aperture 76 and as bulbous portion 38 cannot pass through D-shaped second aperture 78, a detent locking arrangement is formed whereby stem 32 is locked into D-shaped second aperture 78.

A detent locking arrangement is further formed as the movement of stem 32 from round first aperture 76 to D-shaped second aperture 78 causes outwardly-facing forwardly-inclined face 42 of bulbous portion 38 to urge upwardly the spring latch 92 by contact with downwardly-inclined distal tip 95. When stem 32 is engaged by D-shaped second aperture 78, spring latch 92 flexes downwardly into its original position shown in FIGS. 1 and 2 to align adjacently with (or possibly abut) inwardly-facing backwardly-inclined flat face 40 thereby enhancing the detent locking arrangement as any contemplated movement of stem 32 back into generally round first aperture 76 would be obstructed by the contact of downwardly inclined distal tip 95 with inwardly-facing backwardly-inclined flat face 40 of bulbous portion 38.

As shown in FIG. 2, the resulting configuration securely retains the portion of the tubular portion of the frame 200 to the looped portion of a seatbelt 100. Of course, this is typically done for both portions of a seatbelt for a child restraint apparatus.

The resulting configuration results in a very tight locking with no tools required for installation, but which is extremely resistant to disengagement except by the outward flexing of walls 86, 88 (see FIG. 5*b*) while applying inward pressure to the post element 12 and applying upward pressure to spring latch 92, which is not reasonably possible to be done accidentally while a child is being restrained.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A strap retainer apparatus comprising:

a first element with a first end and a second end;

a second element with a first end and a second end, wherein said first end of said first element is joined to a first end of said second element;

said second end of said first element including a first portion of a detent means and said second end of said second element including a second portion of a detent means, wherein said first portion of said detent means is engageable by said second portion of said detent means;

at least one of said first element and said second element being flexible so as to provide a gap between said second end of said first element and said second end of said second element when said first and second portions of said detent means are not engaged;

one of said first and second portions of said detent means including a stem supporting a bulbous portion of increased diameter, the other of said first and second portions including an aperture assembly with a first aperture sized to receive said bulbous portion and a second aperture sized to receive said stem and sized smaller than said bulbous portion, said first aperture and said second aperture being in communication with each other so as to allow said stem to be urged from said first aperture to said second aperture, said second aperture detently retaining said stem therein.

2. The strap retainer apparatus of claim 1 wherein said first element is a generally straight post element and wherein said second element is a generally arcuate retaining element.

3. The strap retainer apparatus of claim 2 wherein said generally arcuate retaining element is flexible so as to provide a gap between said second end of said post element and said second end of said retaining element when said first and second portions of said detent means are not engaged.

4. The strap retainer apparatus of claim 3 wherein communication between said first aperture and said second aperture is provided by walls which taper from a larger portion in said first aperture to a smaller portion in said second aperture.

5. The strap retainer apparatus of claim 4 wherein said smaller portion of said walls meet with said second aperture to form at least one detent edge whereby when said stem is urged from said first aperture to said second aperture, said walls are urged apart from each other and when said stem reaches said second aperture, said walls flex toward each other and said at least one detent edge inhibits movement of said stem from said second aperture to said first aperture.

6. The strap retainer apparatus of claim 5 wherein a cross section of said stem includes at least one flat portion to engage said at least one detent edge.

7. The strap retainer apparatus of claim 6 wherein the cross section said stem includes at least one arcuate portion to urge said walls apart when said stem is urged from said first aperture to said second aperture.

8. The strap retainer apparatus of claim 7 wherein said arcuate portion and said flat portion form a D-shaped cross section of said stem.

9. The strap retainer apparatus of claim 8 wherein said second aperture has a shape substantially identical to said D-shaped cross section of said stem.

10. The strap retainer apparatus of claim 9 wherein said post element includes said stem and said bulbous portion and wherein said retaining element includes said aperture assembly.

11. The strap retainer apparatus of claim 10 wherein said aperture assembly is formed on a planar portion of said second end of said retaining element.

12. The strap retainer apparatus of claim 11 wherein at least one lip is formed on said planar portion to align with a lower surface of said bulbous portion when said stem is detently engaged within said second aperture.

13. The strap retainer apparatus of claim 12 further including a latch means with a downwardly inclined tip cantilevered over said aperture assembly, and said bulbous portion includes an inwardly-facing backwardly-inclined face and an outwardly- facing forwardly-inclined face whereby when said stem is being urged from said first aperture to said second aperture, said outwardly facing inclined face flexes said latch means upwardly, and when said stem is engaged in said second aperture, said latch means flexes downwardly to detently engage said inwardly-facing backwardly-inclined face.

14. The strap assembly apparatus of claim 13 wherein said generally arcuate retaining element is comprised of a plurality of generally straight portions.

15. The strap retainer apparatus of claim 14 wherein said post element and said retaining element are formed of a single molded piece.

16. The strap retainer apparatus of claim 11 wherein a section is formed on a portion of said stem extending away from a lower surface of said bulbous portion.

17. The strap retainer apparatus of claim 16 wherein an outer surface of said section ramps inwardly toward said stem as said section extends away from said lower surface.

18. The strap retainer apparatus of claim 17 wherein said section guides said bulbous portion through said generally round first aperture thereby preventing interference between said bulbous portion and said generally round first aperture.

19. A shopping cart seat belt assembly for retaining a small child securely within the shopping cart, including:

a post having a first end and a second end;

a retaining element having a first end and a second end, wherein said first end of said post is linked to a first end of said retaining element;

said second end of said post including a first portion of a detent and said second end of said retaining element including a second portion of a detent, wherein said first portion of said detent is engageable by said second portion of said detent;

said post and said retaining dement being moveable with respect to one another so as to permit the establishment of a gap between said second end of said post and said second end of said retaining element when said first and second portions of said detent are not engaged;

one of said first and second portions of said detent including a stem supporting a bulbous portion of increased diameter, the other of said first and second portions including an aperture assembly with a first aperture sized to receive said bulbous portion and a second aperture sized to receive said stem and sized smaller than said bulbous portion, said first aperture and said second aperture being in communication with each other so as to allow said stem to be urged from said first aperture to said second aperture, said second aperture having at least one surface forming a detent so as to restrain the movement of the stem from the second aperture to the first aperture and thereby securely retain the stem within the second aperture;

at least one strap having a first end and a second end, the first end being configured for attachment to one of said post and said retaining element; and a cart;

wherein a portion of the cart is configured to be bounded by the post and the retaining element when said second aperture retains said stem so as to securely affix the strap to the cart in a manner that can not readily be manually undone.

20. A shopping cart and seatbelt assembly as set forth in claim 19, wherein said retaining element is flexible so as to provide a gap between said second end of said post element and said second end of said retaining element when said first and second portions of said detent are not engaged.

21. A shopping cart and seatbelt assembly as set forth in claim 20, wherein communication between said first aperture and said second aperture is provided by facing walls which define a channel connecting the first and second apertures, said channel having a first opening that connects the channel with the first aperture and a second opening that connects the channel with the second aperture, the first opening being wider than the second opening.

22. A shopping cart and seatbelt assembly as set forth in claim 21, wherein said walls meet with said second aperture to form at least one detent edge whereby when said stem is urged from said first aperture to said second aperture, said walls are urged apart from each other and when said stem reaches said second aperture, said walls flex toward each other and said at least one detent edge inhibits movement of said stem from said second aperture to said first aperture.

23. A shopping cart and seatbelt assembly as set forth in claim 22, wherein a cross section of said stem includes at least one flat portion to engage said at least one detent edge.

24. A shopping cart and seatbelt assembly as set forth in claim 19, wherein the cart includes a frame having at least one tubular member which is bounded by the post and the retaining element when said second aperture retains said stem so as to securely affix the strap to the cart.

25. A shopping cart and seatbelt assembly as set forth in claim 24, further including a second strap that is attached to the cart via the same structure that attaches the first strap to the cart.

26. A Shopping cart and seatbelt assembly as set forth in claim 19, wherein the retaining element is generally arcuate.

27. A seatbelt assembly for retaining a small child securely within a shopping cart, including:

a first element with a first end and a second end;

a second element with a first end and a second end, wherein said first end of said first element is joined to a first end of said second element;

said second end of said first element including a first portion of a detent and said second end of said second element including a second portion of a detent, wherein said first portion of said detent is engageable by said second portion of said detent;

said first element and said second element being moveable with respect to one another so as to permit the establishment of a gap between said second end of said first element and said second end of said second element when said first and second portions of said detent are not engaged;

one of said first and second portions of said detent including a catch portion, the other of said first and second portions including an aperture assembly having a first aperture and a second aperture that are in communication with each other so as to allow at least a portion of one of said first and second elements to be urged from said first aperture to said second aperture, the second aperture being sized to receive said catch portion and being smaller than the maximum dimension of the catch portion and being sized to securely receive said catch portion through the deformation of one of said catch portion and said second aperture, the relative dimensions of the catch portion and the second aperture being such that the engagement of the catch with the second aperture results in a secure connection that cannot be undone by pulling the first and second elements away from each other; and at least one strap having a first end and a second end, the first end being configured for attachment to one of said first element and said second element;

wherein the seatbelt assembly provides a secure attachment of the strap to a shopping cart when the first and second portions of the detent are engaged with one another that is of sufficient permanence that it can be used in retaining a child securely within a shopping cart.

28. A seatbelt assembly for retaining a small child securely within a shopping cart as set forth in claim 27, wherein the first element comprises a post, and the post includes and terminates in the catch portion.

29. A seatbelt assembly for retaining a small child securely within a shopping cart as set forth in claim 28, wherein said second aperture detently retains at least a portion of said post.

30. A seatbelt assembly for retaining a small child securely within a shopping cart as set forth in claim 27, further comprising a cart to which the seatbelt assembly is secured.

* * * * *